US010407193B2

(12) United States Patent
Bocedi et al.

(10) Patent No.: US 10,407,193 B2
(45) Date of Patent: Sep. 10, 2019

(54) MACHINE FOR THE WRAPPING OF PALLETS

(71) Applicant: OFFICINA BOCEDI S.R.L., Scandiano (Reggio Emilia) (IT)

(72) Inventors: Stefano Bocedi, Reggio Emilia (IT); Federico Busato, Rio Saliceto (IT)

(73) Assignee: OFFICINA BOCEDI S.R.L., Scandiano (IT)

( * ) Notice: Subject to any disclaimer, the term of this patent is extended or adjusted under 35 U.S.C. 154(b) by 339 days.

(21) Appl. No.: 15/263,418

(22) Filed: Sep. 13, 2016

(65) Prior Publication Data

US 2017/0073092 A1 Mar. 16, 2017

(30) Foreign Application Priority Data

Sep. 16, 2015 (IT) ..... 102015000052180

(51) Int. Cl.
*B65B 11/02* (2006.01)
*B65B 41/16* (2006.01)
(Continued)

(52) U.S. Cl.
CPC ..... *B65B 11/02* (2013.01); *B65B 9/135* (2013.01); *B65B 41/16* (2013.01); *B65B 51/22* (2013.01); *B65B 59/00* (2013.01); *B65B 61/06* (2013.01)

(58) Field of Classification Search
CPC .. B65B 9/135; B65B 9/13; B65B 9/14; B65B 59/00; B65B 59/04; B65B 11/02;
(Continued)

(56) References Cited

U.S. PATENT DOCUMENTS 3,897,674 A * 8/1975 Higgins ..... B65B 9/135 53/567
7,036,289 B2 * 5/2006 Suolahti ..... B65B 11/025 53/201

(Continued)

FOREIGN PATENT DOCUMENTS

DE 102010025609 A1 1/2012
EP 2767479 A1 8/2014
EP 2902328 A1 8/2015

*Primary Examiner* — Chelsea E Stinson
*Assistant Examiner* — Thomas M Wittenschlaeger
(74) *Attorney, Agent, or Firm* — Pearne & Gordon LLP

(57) ABSTRACT

A machine for the wrapping of pallets (P) by means of a stretchable film cap, comprising: a main frame (1) which defines a working area (A) of the machine; a traction device (2), predisposed for lowering the film cap and for fitting it onto the pallet (P); a feeder device (3) arranged to feed the film to the traction device (2); a cutting and welding device (4) of the film, arranged to cut and weld the film so as to obtain a cap closed at one end thereof;
in which the feeder device (3) is movable along the frame (1) between an operating position, located superiorly to the main frame (1), and a service position, in which said feeder device is located at a given height from the ground, on one side of the main frame (1).
The feeder device (3) is movable on an outside area of the main frame (1) and, when switching from the operating position to the service position, the feeder device (3) is maintained externally of the main frame (1), without cluttering the working area (A).

8 Claims, 4 Drawing Sheets

(51) Int. Cl.

| | |
|---|---|
| ***B65B 51/22*** | (2006.01) |
| ***B65B 61/06*** | (2006.01) |
| ***B65B 59/00*** | (2006.01) |
| ***B65B 9/13*** | (2006.01) |

(58) Field of Classification Search
CPC ..... B65B 41/16; B65B 61/06; B65B 51/22; B65B 9/10
USPC ..... 53/459, 567, 393
See application file for complete search history.

(56) References Cited

U.S. PATENT DOCUMENTS

| | | | | |
|---|---|---|---|---|
| 7,913,476 | B2 * | 3/2011 | Lachenmeier | B65B 59/04 53/393 |
| 9,878,814 | B2 * | 1/2018 | Geerts | B65B 59/04 |
| 2011/0185687 | A1 * | 8/2011 | Michels | B65B 9/135 53/556 |
| 2013/0133290 | A1 * | 5/2013 | Tebeck | B65B 9/135 53/450 |
| 2014/0230380 | A1 * | 8/2014 | Geerts | B65B 59/04 53/556 |
| 2014/0250831 | A1 * | 9/2014 | Suolahti | B65B 11/025 53/203 |

* cited by examiner

MACHINE FOR THE WRAPPING OF PALLETS

The present invention relates to a machine for the wrapping of pallets. In particular, the present invention relates to a machine predisposed to fit a cap of stretchable film onto a pile of articles arranged on a pallet.

The machines currently available for the wrapping of pallets by means of a cap of stretchable film comprise a frame, with mainly vertical development, with which a device for feeding the film, a device for cutting and welding the film, and a device for positioning the film are associated.

The film feeder device removes a section of tubular stretchable film from a storage, typically realised in the form of a wound roll of the film. The section of film is normally obtained by unwinding from the storage.

The cutting and welding device, positioned beneath the feeder device, is predisposed to cut and weld the film, so as to obtain a cap closed at one end thereof.

The film positioning device, positioned beneath the cutting and welding device, is predisposed for gripping the lower edges of the film cap and for lowering the cap itself, fitting it onto the pile of articles beneath.

The machines currently available are divided substantially into two types. In a first type of machine, all the operating devices briefly described above are associated with the upper part of the frame, which may reach considerable heights. This makes it necessary to predispose access ladders or walkways at the upper part of the frame so as to allow maintenance operations on said devices. Said access ladders and walkways require appropriate safety measures to be adopted, often obligatory, to prevent accidental falling of operators.

In a second type of machine, the operating devices briefly described above are provided with the possibility of sliding vertically along the machine frame, being able to lower substantially to ground level to allow performance of maintenance operations on the ground.

An example of a machine of the second type is known from document EP2767479. The machine described in this document comprises a main frame defined by four uprights superiorly joined by a plurality of cross-members. An upper frame, which bears both the feeder device and the cutting and welding device, is vertically slidably associated to the main frame. The upper frame is further provided with the ability to take on an operating configuration, in which it is orientated in a horizontal position, and a service configuration, in which it is orientated in a vertical position on a side of the main frame. In the service position the feeder device and the cutting and welding device are substantially within easy reach for a person, so that any maintenance operations can be carried out from a ground position.

In the machine briefly described in the foregoing, and in other machines of the same type, the upper frame cannot assume the service position if a pallet is present in the machine. In other terms, in order to bring the upper frame into the service position it is necessary for the work space delimited by the main frame to be unoccupied. This implies that in the case where a need emerges for an intervention on the upper frame during the wrapping of a pallet, the operations are inevitably suspended and the pallet must be moved away from the machine, with consequent waste of time and material. Further, the structure and mechanisms necessary for the movement of the upper frame are rather complex and expensive.

The aim of the present invention is to provide a machine for the wrapping of pallets which allows the drawbacks of the currently available machines to be obviated.

An advantage of the machine according to the present invention is that it enables carrying out at least some maintenance operations even in the presence of a pallet in the working area.

Another advantage of the machine according to the present invention is that it can be easily integrated into already existing plants.

Another advantage of the machine according to the present invention is that it requires more modest spaces with respect to the machines available at present.

Further characteristics and advantages of the present invention will become more apparent in the following detailed description of an embodiment of the present invention, illustrated by way of non-limiting example in the attached figures, in which.

Figure 1:
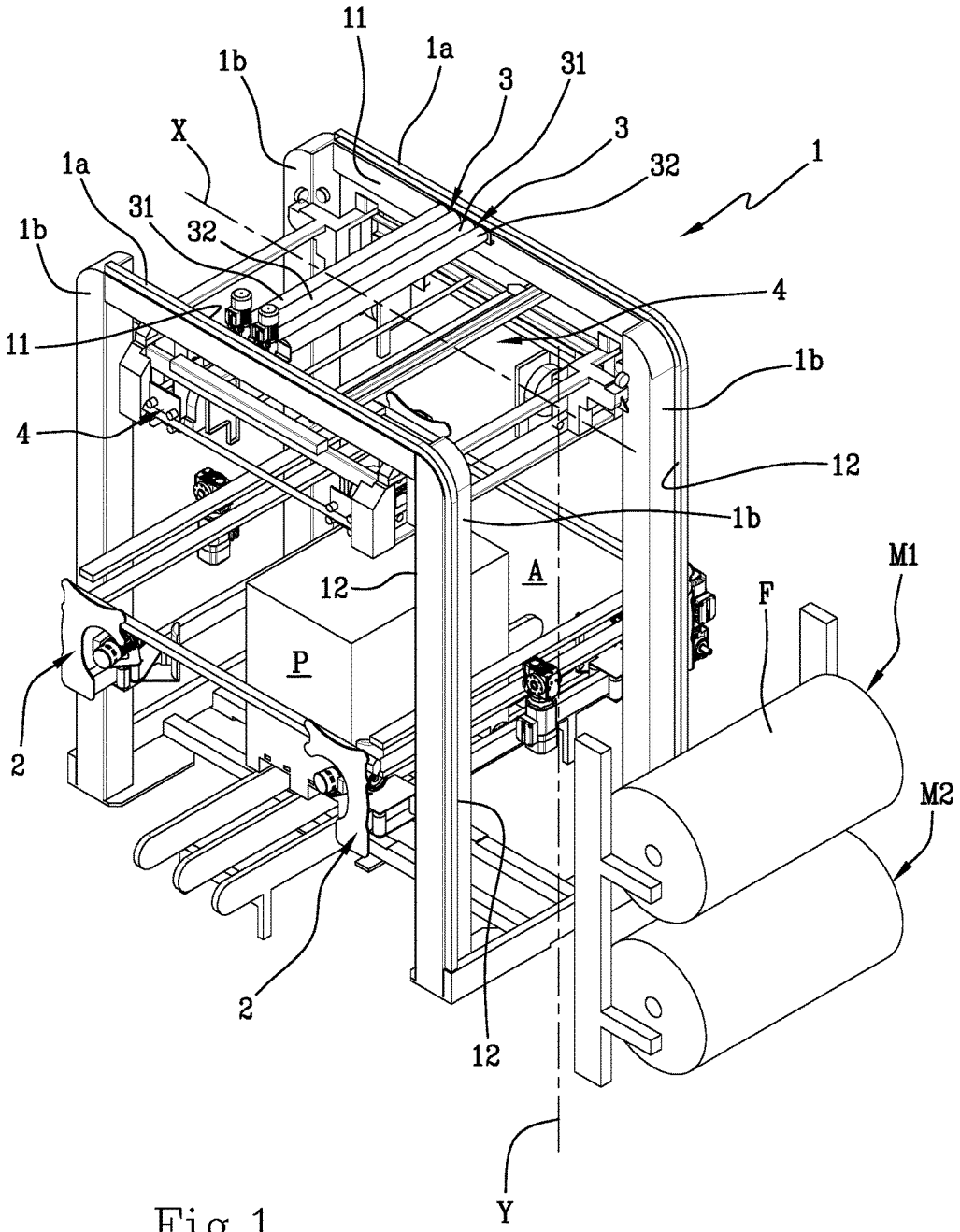
FIG. 1 shows a first schematic axonometric view of the machine according to the present invention, in an operating configuration.

The machine according to the present invention comprises a main frame (1) which delimits a working area (A) of the machine. The working area (A) of the machine is substantially the space in which the pallet (P) to be wrapped is located and in which the machine carries out the wrapping. The main frame (1) comprises a bearing structure, destined to be supported and fixed on a base or on the ground. In a preferred embodiment, the main frame (1) comprises one or more upper cross-members (1*a*), for example a pair of upper cross-members (1*a*) that are parallel to one another. The frame further comprises one or more uprights (1*b*), for example a pair of uprights (1*b*) parallel to one another and connected to the upper cross-members (1*a*). The main frame (1) preferably comprises two pairs of uprights (1*b*), each of which is connected to a respective end of the upper cross-members (1*a*). The uprights and the cross-members can be connected to one another by means of further uprights or cross-members (not described in detail) with the aim of increasing the rigidity of the main frame (1). The cross-members and the uprights of the main frame (1) define a bearing structure which internally delimits the working area (A).

The machine further comprises a traction device (2), predisposed for lowering the cap of film to fit it on the pallet (P). This traction device (2), in substance, grips the end of the film (F) from below, broadens it out into a tubular configuration and lowers the film to fit it on the pallet.

The film (F) is fed to the traction device (2) by means of a feeder device (3), located above the traction device (2).

A cutting and welding device (4) is positioned between the feeder device (3) and the traction device (2), which cutting and welding device (4) is predisposed to cut and weld the film, so as to obtain a cap closed at one end.

The functioning of the machine, in itself of known type, includes feeding a section of film (F) of a determined length to the traction device (2), which proceeds to open out and collect the section of film (F). Once the desired length has been obtained the cutting and welding device (4) cuts the film (F) and welds the cut edges so as to obtain a cap which thereafter is lowered and fitted on the pallet. On completion of the cycle the traction device (2) newly rises towards the initial position thereof in which it is supplied with a new section of film (F) unwound from the feeder device (3) and cut by the cutting and welding device (4).

Both the traction device (2) and the cutting and welding device (4) are well known to the technical expert in the sector.

The traction device (2) comprises for example four gripping units (21), arranged substantially at the vertices of a quadrilateral. Each gripping unit (21) is mobile on a horizontal plane along two perpendicular axes. The vertical motion of the traction device (2) is obtained by means of sliding of the gripping units (21) along the uprights (1*b*) of the main frame (1), operated by actuators of a known type.

Each gripping unit comprises a hooking element, predisposed to be inserted at least partially into the film below a lower edge of the film. The hooking element is for example in the form of an elongated plate, orientated vertically and shaped so as not to cause damage to the film. The hooking element is predisposed to drag and enlarge the tubular film through the sliding motions of the gripping unit (21) along the horizontal sliding directions.

The gripping units (21) are initially in a position in which they are close to each other. In this position, they are raised towards the lower edge of the overlying film (F) coming from the feeder device (3). Each hooking element is positioned inside the film (F). Subsequently, the gripping units (21) are distanced from each other by sliding, until they reach the vertices of a quadrilateral. By moving away from each other, the hooking elements stretch the lower edge of the film (F) so that it is positioned in plan view according to a corresponding quadrangular shape.

Each gripping unit (21) also comprises a motorised roller, predisposed to approach the hooking element and to grip the film on the hooking element. Thus, when activated in rotation, the motorised roller collects the film between itself and the hooking element alongside it. The simultaneous action of the four motorised rollers therefore leads to total collection, along a vertical direction, of a section of film coming from the feeder device (3). The section of film is collected in a sleeve fashion about the hooking Elements. Thereafter the gripping units (21) are lowered to fit the film (F) on the pallet. The film stretches once again in contact with the pile of articles, progressively unwinding from the hooking elements. Once the arrangement of the film (F) on the pallet is completed, said pallet is evacuated and replaced by a new pallet to be wrapped and the gripping units (21) return to the initial position for a new cycle of operations identical to the one described.

The cutting and welding device (4) comprises a pair of operating elements, of which at least one may be heated to a melting temperature of the film. The two operating elements are mobile between an operating position, in which they are alongside each other to grip a section of the film, and a release position, in which they are distanced from each other. The two operating elements are controlled by actuators at the disposal of the person skilled in the art. The two operating elements are arranged beneath the feeder device (3) and act on the film which is still in the flattened configuration in two superimposed layers. In the operating position, the heat and the pressure action exerted by the operating elements on the film, which is flattened in two superimposed layers, cause the cutting of the film and the fusion between the two layers.

The feeder device (3) is movable along the frame (1) between an operating position (FIG. 1), located superiorly to the main frame (1), and a service position (FIG. 2), in which the feeder device is located at a given height from the ground, on one side of the main frame (1). In the operating position, illustrated in FIG. 1, the feeder device (3) is located above the traction device (2) and feeds the film (F), collecting it from a storage (M1, M2, . . . ). In the service position, illustrated in FIG. 2, the feeder device (3) is arranged on a side of the frame (1) at a height that is within easy reach of a person, so that each necessary maintenance or film (F) replacement intervention can be carried out from a ground position.

The feeder device (3) is advantageously movable on an outside area of the main frame (1) and, during the switching from the operating position to the service position, the feeder device (3) is maintained externally of the main frame (1), without cluttering the working area (A). This implies that the feeder device (3) can be brought into the service position regardless of the presence of a pallet or any other object or machinery located in the working area (A). For example if the film reel runs out during the course of wrapping a pallet, it is not necessary to remove the pallet from the machine, as is the case with machines available at present, but it is sufficient to shift the feeder device (3) into a service position and associate a new reel of film thereto. This enables significantly reducing the overall height of the machine. On the contrary, other machines at present available have considerable heights for preventing the displacement of the feeder devices from interfering with a pallet present in the machine.

In a preferred but not exclusive embodiment, the main frame (1) is provided with guides (11,12) extending on an upper portion and a side portion of the main frame (1), on an external part of the main frame (1). The guides (11,12) are structured such as to maintain the feeder device (3) in a position external of the main frame (1) and the working area (A). In other terms the guides (11,12) are operative on an external part of the main frame (1), in such a way that the feeder device (3) is always external of the main frame (1) and the working area (A).

In a preferred embodiment, the guides (11,12) comprise a first portion (11), associated to an upper portion of the main frame (1), and a second portion (12), associated to a side portion of the main frame (1).

In the upper portion of the main frame (1), the feeder device (3) is mobile on the first portion (11) of the guides (11,12) along a first direction (X) which lies on a plane, preferably horizontal or slightly inclined with respect to the horizontal plane. In the side portion of the main frame, the feeder device (3) is mobile on the second portion (12) of the guides (11,12) along a second direction (Y) which lies on a different plane from the previous one, preferably vertical or slightly inclined with respect to the vertical plane.

The movement of the feeder device (3) along the guides (11,12) can be realised for example by means of a chain transmission, of a type well known to the technical expert in the sector and therefore not described in detail.

The guides (11,12) comprise for example one or more profiled elements, widely known to the technical expert of the sector and therefore not described in detail, along which the feeder device (3) is made to slide.

In the preferred embodiment of the machine, the guides (11,12) comprise a first portion (11), associated to the upper cross-members (1*a*) and a second portion (12), associated to the uprights (1*b*). The first portion (11) is parallel to the first direction (X) and comprises for example a pair of profiled elements parallel to one another and each associated to a cross-member (1*a*). The second portion (12) is parallel to the second direction (Y) and comprises for example a pair of profiled elements parallel to one another and each associated to an upright (1*b*). A connecting sector conjoins the two portions (11,12) of the guides.

The feeder device (3) preferably comprises a pair of rollers (31,32) the ends of which are slidably associated to the main frame (1). In particular, the ends of the rollers (31,32) are slidably associated to the guides (11,12) solidly constrained to the main frame (1). The rollers (31,32) are located at a distance that is such as to be able to squeeze the film (F) between them in a flattened configuration. At least one of the two rollers (31,32) is motorised so as to be able to determine the sliding of the film (F) on command.

Figure 2:
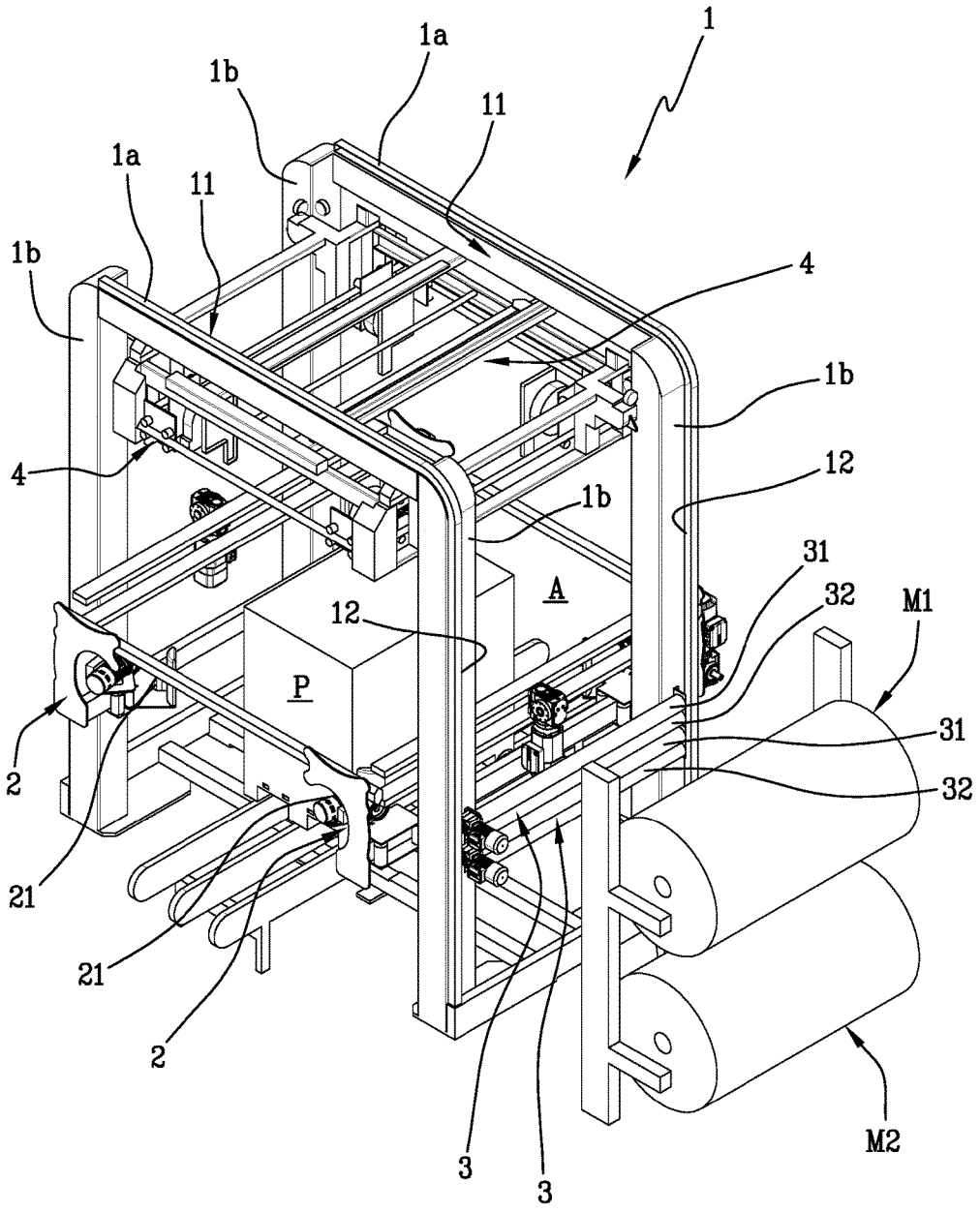
FIG. 2 shows a second schematic axonometric view of the machine according to the present invention, in a service configuration.

In the embodiment illustrated in FIGS. 1 and 2, the rollers (31,32) move solidly along the external part of the frame (1), but are not constrained to one another, i.e. each roller follows its own trajectory along the guides (11,12). This means that the rollers (31,32) in the operating position lie on a substantially horizontal plane, while in the service position they lie on a substantially vertical plane.

Figure 3:
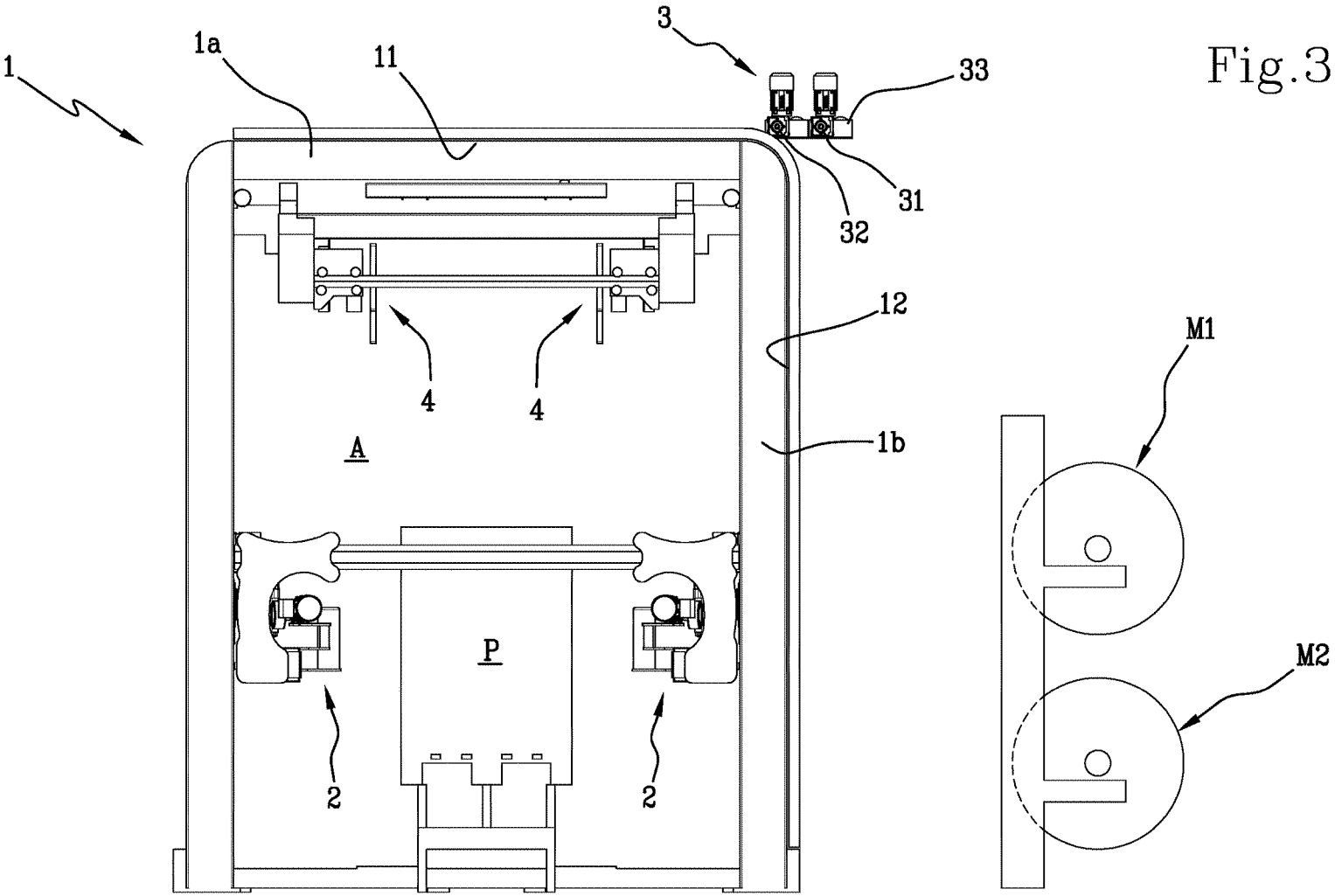
FIG. 3 shows a vertical elevation view of a second embodiment of the machine, in an operating configuration.
Figure 4:
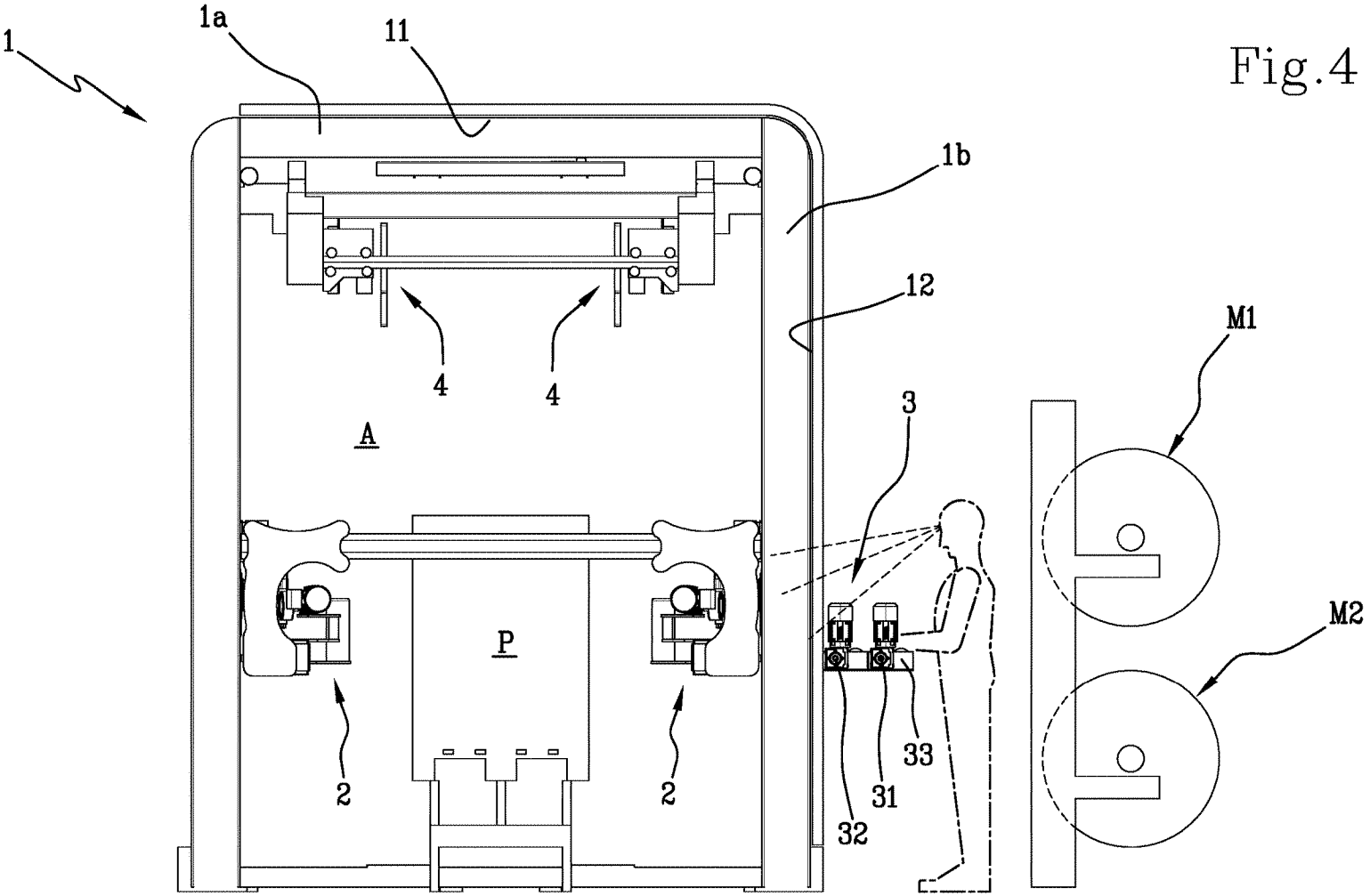
FIG. 4 shows the machine shown in FIG. 3 in a service configuration.

In the embodiment illustrated in FIGS. 3 and 4, the rollers (31,32) are associated to a mobile frame (33) at the ends thereof. The mobile frame (33) is in turn moveable along the guides (11,12) solidly constrained to the frame (1). The mobile frame (33) preferably maintains the same orientation during the displacements between the operating position and the service position. In particular, the mobile frame (33) is horizontal even in the service position, illustrated in FIG. 4. For this purpose the guides (11,12) have an output section, located about in the transition zone between the first portion (11) and the second portion (12), structured in such a way as to enable the frame (33) to disengage from the guides (11,12) with the exception of a rear part (31*b*) which always remains engaged to the first (11) and second portion (12). The output section is not illustrated in detail as the technical expert in the sector is perfectly able to realise a solution having the above-described characteristics.

In an advantageous embodiment, the machine comprises two or more feeder devices (3) each of which comprises a pair of rollers (31,32) the ends of which are slidably associated to the main frame (1), in particular to the guides (11,12) solidly constrained to the main frame (1). This enables contemporaneously using more than one film (F) having different format and/or different characteristics, each managed by a respective feeder device (3). In the operating position the feeder devices (3) are preferably mutually coplanar and alongside one another. In this way it is possible to change the film to be used simply by activating the feeder device (3) dedicated to the management of the desired film, feeding the film to the traction device (2). If necessary and/or requested, it is further possible to precisely adjust the operating position of each feeder device (3), by translating it along the upper portion of the frame (1), in particular along the first portion (11) of the guides, so as to find the desired alignment with the traction device (2). The feeder devices (3) can translate solidly with one another by means of the chain transmission mentioned in the foregoing.

The illustrated embodiment comprises two feeder devices (3), but it is possible to include the use of a greater number of feeder devices (3).

In relation to the number of feeder devices (3) the machine comprises two or more storages (M1, M2, . . . ) predisposed for accommodating a respective reel of stretchable film. The storages are for example in the form of rollers on which the film reel is wound. At least one end free portion of each reel extends between the respective storage (M1, M2, . . . ) and a respective feeder device (3). In particular one end portion of each reel is retained by the respective feeder device (3).

The storages (M1, M2, . . . ) are located preferably alongside the main frame (1), roughly in front of the service position of the feeder device(s) (3). In this way when the feeder devices (3) are in the service position it is very easy to insert the end of a reel of film in a feeder device (3).

The machine according to the present invention offers important advantages.

The possibility for the feeder devices (3) to slide on the outside of the main frame (1) without cluttering the working area (A) enables making the maintenance operations on the feeder devices (3) independent, including the reel changes, with respect to the presence or not of a pallet in the working area (A). Further, the possibility for the feeder devices (3) to slide on the outside of the main frame (1) reduces the spaces required for installation of the machine, as also in the operating position the feeder devices (3) remain alongside the main frame (1). This also enables nearing the storages (M1,M2, . . . ) to the main frame (1), further reducing the spaces necessary for the installation of the machine.

The invention claimed is:

1. A machine for the wrapping of pallets (P) by means of a stretchable film cap, comprising: a main frame (1) comprising a first pair and a second pair of uprights (1*b*), each upright (1*b*) being connected to a respective end of an upper cross-member (1*a*), said cross-members (1*a*) and uprights (1*b*) of the main frame (1) defining a bearing structure which internally delimits a working area (A) of the machine; the working area (A) extending (a) from a bottom of the cross-members (1*a*) downwardly and (b) from the first pair of uprights (1*b*) to the second pair of uprights (1*b*), said main frame (1) being provided with guides (11, 12) extending on an upper portion and a side portion of the main frame (1); a traction device (2), predisposed for lowering the film cap and for fitting it onto the pallet (P); a feeder device (3) arranged to feed the film to the traction device (2); a cutting and welding device (4) of the film, arranged to cut and weld the film so as to obtain a cap closed at one end thereof;

wherein the feeder device (3) is movable along the frame (1) between an operating position, located superiorly to the main frame (1), and a service position, in which said feeder device (3) is located at a given height from the ground, on one side of the main frame (1);

characterised in that the feeder device (3) comprises a pair of rollers (31, 32) which are adapted to guide the film between said rollers (31, 32), the ends of said rollers (31, 32) being slidably associated to said guides (11, 12), said guides (11,12) being structured such as to maintain the feeder device (3) externally of the main frame (1) and the working area (A), during the displacement between the operating and service positions.

2. The machine according to claim 1, wherein the guides (11,12) comprise a first portion (11) associated to the upper portion of the main frame (1), and a second portion (12) associated to the side portion of the main frame (1).

3. The machine according to claim 2, wherein the feeder device (3) is mobile on the first portion (11) of the guides (11,12) along a first direction (X), and is mobile on the second portion (12) of the guides (11,12) along a second direction (Y) which is inclined with respect to the first direction (X).

4. The machine according to claim 2, wherein the first portion (11) is associated to the upper cross-members (1*a*) and the second portion (12) is associated to the uprights (1*b*).

5. The machine according to claim 2, wherein:

the rollers (31,32) are associated to a mobile frame (33) at the ends thereof;

the mobile frame (33) is in turn moveable along the guides (11,12) solidly constrained to the main frame (1);

the guides (11,12) have an output section, located in a transition zone between the first portion (11) and the second portion (12), structured in such a way as to enable the mobile frame (33) to disengage from the guides (11,12) with the exception of a rear part of the mobile frame (33) which always remains engaged to at least one of the first portion (11) and the second portion (12), such that the mobile frame (33) is able to maintain the same orientation during the displacement between the operating position and the service position.

6. The machine according to claim 1, comprising two or more feeder devices (3) each of which comprises a pair of rollers (31,32), the ends of said rollers (31, 32) being slidably associated to the main frame (1).

7. The machine according to claim 6, wherein the two or more feeder devices (3) are mutually coplanar and alongside one another when in the operating position thereof.

8. The machine according to claim 6, comprising two or more storages (M1, M2, . . . ) predisposed for accommodating a respective stretchable film reel; at least one end free portion of each reel extends between the respective storage (M1, M2, . . . ) and a respective feeder device (3); at least one end portion of each reel is retained by the respective feeder device (3).

* * * * *